United States Patent [19]

Schneider

[11] Patent Number: 4,754,575

[45] Date of Patent: Jul. 5, 1988

[54] ECCENTRIC GRINDER WITH MEANS FOR CHANGING A GRINDING MOTION

[75] Inventor: Helmut Schneider, Leingfelden-Echterdingen, Fed. Rep. of Germany

[73] Assignee: Robert Bosch GmbH, Stuttgart, Fed. Rep. of Germany

[21] Appl. No.: 30,068

[22] Filed: Mar. 24, 1987

[30] Foreign Application Priority Data

May 10, 1986 [DE] Fed. Rep. of Germany ..... 3615799

[51] Int. Cl.[4] ..... B24B 7/00

[52] U.S. Cl. ..... 51/120; 51/119; 51/170 MT

[58] Field of Search ..... 51/120, 170 R, 170 MT, 51/119; 15/98, 49 R

[56] References Cited

U.S. PATENT DOCUMENTS 4,322,921 4/1982 Maier ..... 51/170 MT

*Primary Examiner*—Frederick R. Schmidt
*Assistant Examiner*—Lawrence Cruz
*Attorney, Agent, or Firm*—Michael J. Striker

[57] ABSTRACT

The eccentric grinder with an eccentric drive and a drive, which provides a rolling motion of two enagageable gear toothings, has gear toothings provided on the grinding disk and on the housing, respectively of the eccentric grinder. Some toothings are concentrical to the drive shaft, while the toothing on the grinding disk is eccentrically supported relative to the drive shaft. The grinder has at least three different grinding disks, of which one has the gear toothing engageable with one of the toothings on the housing and thus can carry out, due to the operation of the shaft, a predetermined grinding motion. The second grinding disk has a toothing for engaging with another toothing provided on the housing, whereby another grinding motion is obtained. The third grinding disk has no toothing and its grinding motion is obtained from the eccentric drive only and adjusted to a counter pressure force.

3 Claims, 2 Drawing Sheets

ECCENTRIC GRINDER WITH MEANS FOR CHANGING A GRINDING MOTION

BACKGROUND OF THE INVENTION

The present invention relates to an eccentric grinder of the type provided with means for changing a grinding motion.

Eccentric grinders of the foregoing type include a grinding disc eccentrically positioned in respect to a drive shaft of the grinder motor. Such eccentric grinders have been available on the market and have been disclosed, for example in "Fachberichte für Metallbearbeitung", Apr. 3, 1983, with the title "Rotex, die neue Dimension des Schleifens". Despite known advantages of such eccentric grinders an optional adjustment of such a grinder to practical requirements has not been possible. The gap between the pure course grinding and fine grinding has been too large. To avoid such a problem it has been suggested to provide a further drive stage with different diameters of the friction or toothed gears; this however has been conceivable only with a considerable enlargement of the structural components of the drive. Otherwise, the switching from one type of the drive to another type of the drive has always involved a big expense on the adjustment means. Such adjustment means must be robust and thus large for the drive but should, however be not succeptible to damage. With the utilization of the toothings on the grinding plate, the teeth of the toothings can be however damaged if the personnel is careless.

SUMMARY OF THE INVENTION

It is an object of the present invention to provide an improved eccentric grinder.

It is another object of the invention to provide an eccentric grinder with an optimal output, but of a simple structure which requires very little space.

Yet another object of the invention is to provide an eccentric grinder by which it will be obtained in a simple manner that a correct hardness of the grinding disk and correct grain of the grinding paper would correspond to a selected fashion of grinding.

These and other objects of the invention are attained by an eccentric grinder comprising a housing; an eccentric drive for driving a grinding disk; and a further drive means including a driving shaft and a first at least friction ring and gear toothing rotationally supported on said shaft and eccentrical in respect to said grinding disk for a forcible rolling motion on a second at least friction rolling ring and gear toothing which is provided on said housing and is concentrical with said driving shaft, said eccentric drive and said drive means being interchangeable, the grinder having a plurality of said second at least friction rolling rings and said gear toothings fixed to said housing, and a plurality of different grinding disks one of which has said first at least friction rolling ring and gear toothing adjusted to one of said second ring and gear toothing and one of which being formed without said rings and crown toothings, said grinding disks being selectively supportable on said driving shaft.

In order to adjust the grinder to the fashion of grinding only one grinding disk should be used, which is either provided with one of the friction roll rings or gear toothings or has no rings or toothings at all. Thus a desired drive manner, the required hardness of the grinding disk and the grain size of the grinding paper are adjusted by a single disk-exchange process. If the grinding disk is provided with the grinding sheet of a given grain size an operator can select the grinding mode between coarse, medium or fine by the use of the certain grinding disk.

One of said crowns fixed to said housing may be an internal gear toothing and one of said gear toothings fixed to said housing may be an external gear toothing, said grinding disks being provided with said respective first gear toothings of which one is an external toothing and the other is an internal toothing adjusted to said internal and external gear toothings fixed to said housing.

Each grinding disk may have a coating, the coatings and structures of said grinding disks being adjusted to a given grinding fashion "coarse-medium-fine".

Each grinding disk may carry marks indicating a grinding fashion for an intended ground slide.

The novel features which are considered as characteristic for the invention are set forth in particular in the appended claims. The invention itself, however, both as to it construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
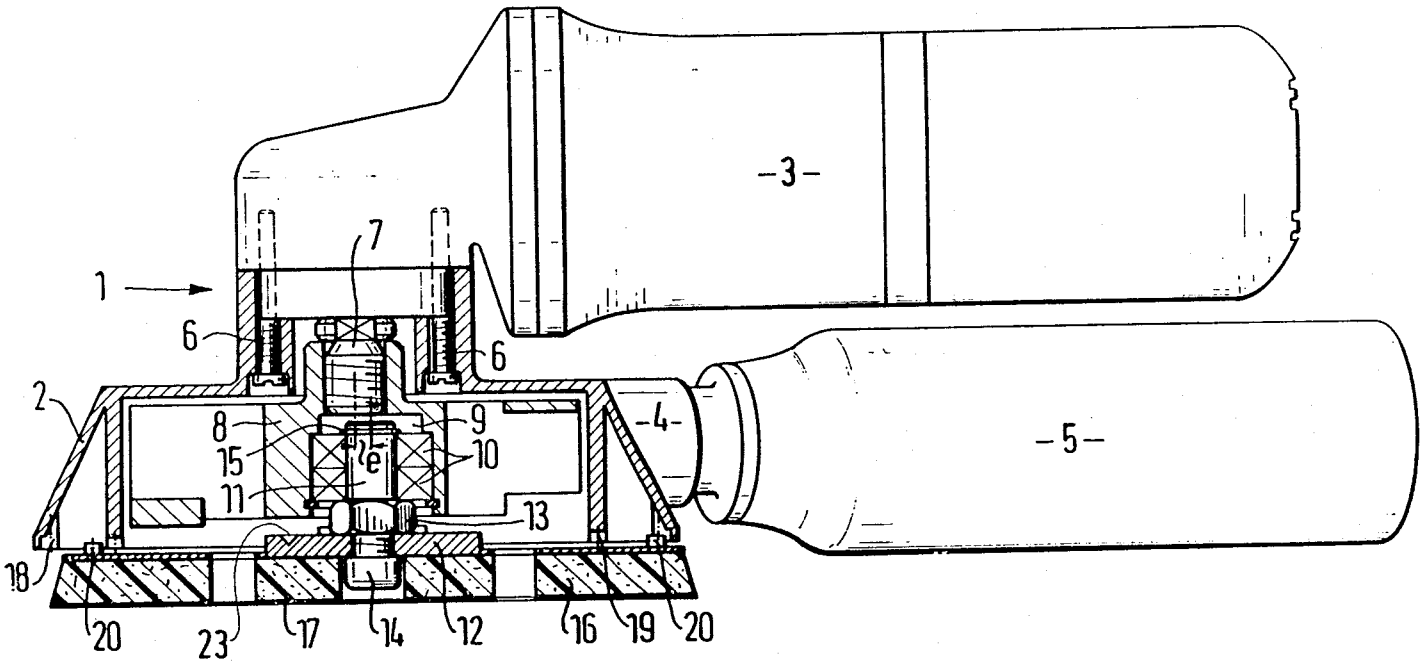
FIG. 1 is a side view, partially in section, of an eccentric grinder according to the invention.
Figure 2:
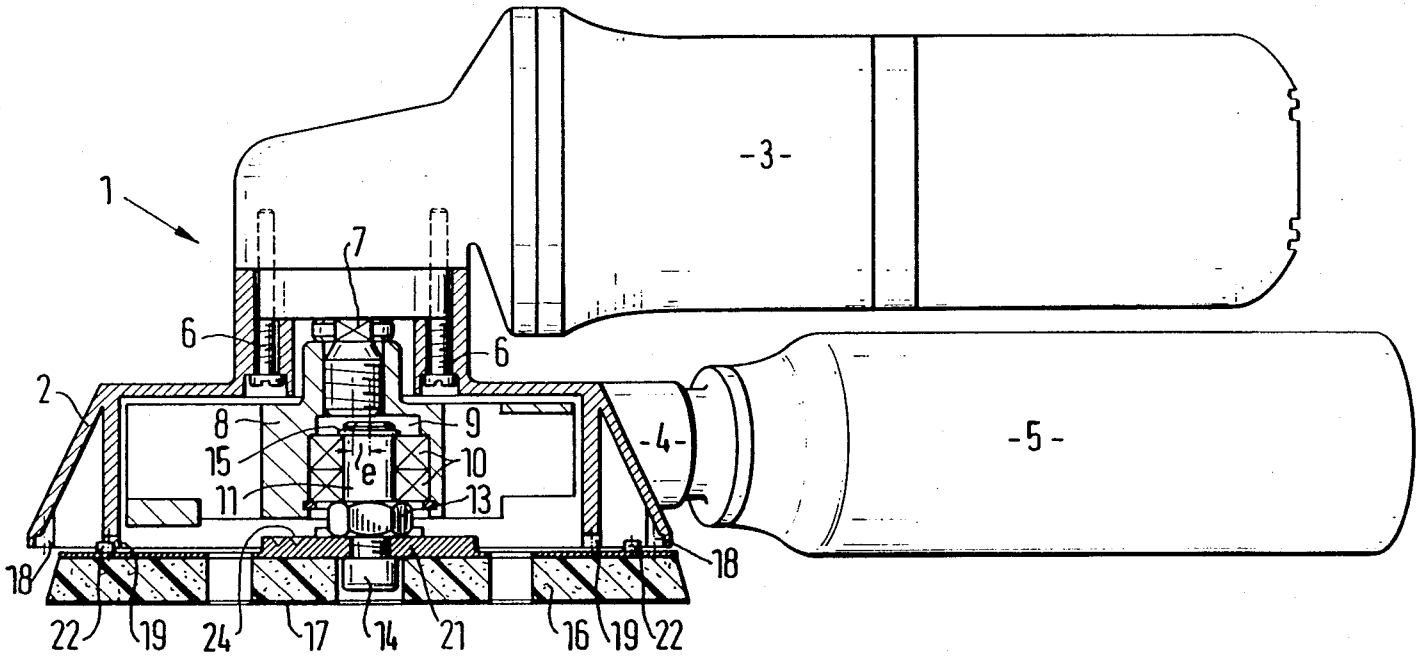
FIG. 2 is a side view, partially in section, of the eccentric grinder having a different toothing for the forcible drive of the grinding disk.

As seen from FIGS. 1 and 2 the eccentric grinder 1 has a housing 2 for a grinding disk drive and a motor housing 3. Housing 2 is provided with a support 4 for connecting thereto of a suction device 5. Housing 2 is flanged to the motor housing 3 and is secured to the same by bolts 6. A drive shaft 7 extends outwardly from the motor housing 3. An intermediate element 8 is screwed to the shaft 7. The intermediate element 8 is formed as a crank and has a cylindrical recess which is eccentric to the axis of the drive shaft 7. The eccentricity that is the distance between the central axis of shaft 7 and the central axis of recess 9, is indicated at "e". Two ball bearings 10 are provided, which receive a supporting pin 11 for a grinding disk 12. Supporting pin 11 has a hexazonal end portion 13 and a threaded bore into which a bolt 14 can be screwed. The hexagonal portion 11 and the safety washer 15 secure the supporting pin 11 against the axial displacement in the ball bearings 10.

The grinding disk 12 is connected by means of the bolt having an inner hexagonal recess to the support pin 11. Grinding disk 12 carries an interchangeable glue coating which serves to receive a grinding paper 17. Housing 2 is provided with an internal gear toothing 18 and an external gear toothing 19. These gear toothings 18 and 19 are mounted concentrically with the drive shaft 7. Grinding disk 12 carries at its inner surface an external gear toothing 20 which is concentrical with the central axis of support pin 11 and thus eccentrical to the drive shaft 7. All external gear toothings have teeth projecting radially outwardly from an axis of rotation of a respective structural component whereas the teeth of all internal gear toothings project radially inwardly towards said axis, as known.

When the grinding disk 12 is connected to the support pin 11 the external gear toothing 20 comes into engagement, in the vicinity of the contact spot between the circles of the gear toothings 18 and 20, with the internal gear toothing 18 of the housing 2.

Inasmuch as during the grinding process the internal gear toothing 18 is stationary since it is part of housing 2 the external gear toothing 20 rolls on the teeth of the gear toothing 18 and defines in this fashion the grinding movement of the grinding disk 12. Each grinding grain on the grinding paper 17 describes an elongated hypocycloid whereby it moves counter to the direction of rotation of the eccentric. This results in a greater material removal than during the grinding without a forcible rolling motion. The grinding pattern lies approximately midway between the coarse grinding and fine grinding.

The grinding without the forced rolling motion results in the fine ground pattern, that is with the non-shown grinding disk having no gear toothing thereon. The drive of such a grinding disk is obtained via the intermediate element 8 with its eccentrical recess 9. By the supporting of the pin 11 in the ball bearings 10 this grinding disk is freely rotable on the support pin 11. This grinding disk executes therefore, during the grinding process, the motion which follows the cycloid with the superposed rotation. The superposing of the rotation movement is thereby dependent upon the counter pressure during the grinding. The path of each individual grinding grain per eccentric revolution is very small which results in the fine ground pattern. The material removal is small accordingly. This grinding movement is particularly suitable for grinding multi-step transition zones.

In FIG. 2 the grinding disk 21 has an internal gear toothing 22 which is adjusted for cooperating with the external gear toothing 19 provided on the housing 2. All other structural components of the embodiment of FIG. 2 are identical to that of FIG. 1.

When the grinding disk 21 is connected to the support pin 11 the internal gear toothing 22 comes into engagement with the external gear toothing 19 whereby the partial circles of both gear toothings 19 and 22 come into contact with each other. Since during the grinding process the external gear toothing 19 is fixed since if the part of housing 2, the internal gear toothing 22 rolls on the teeth of toothing 19 and defines in such a way the grinding motion of the grinding disk 21. Each grinding grain on the grinding sheet 17 describes a pericycloid whereby the direction of the rotation motion coincides with the direction of rotation of the eccentric. Thus the path of the grinding grain per revolution of the eccentric is here the greatest. This grinding motion effects the largest material removal and is thus suitable for the course grinding and not for the grinding of fine transition zones.

According to a respective grinding disk (12, 21 and a non-shown disk without any gear toothing) and due to the grinding quality for its typical grinding motion of the respective disk it is determined whether each such grinding disk can be provided with a respectively grained grinding paper 17. Since, however, the hardness of the coating 16 must vary in dependence upon the ground pattern a harder or softer coating should correspond to a respective grinding disk.

Accordingly, the friction gear or gear toothings 18, 19, 20 are provided on the grinding disk 12 and the housing 2 of the eccentric grinder 1, respectively. As mentioned above, gear toothings 18, 19 are concentrical to the drive shaft 7 while gear toothing 20 on the grinding disk 12 is eccentrically supported relative to the drive shaft 7. This grinder has three different grinding disks 12 of which one has the gear toothing 20 engageable with one of the gear toothings 18, 19 on the housing 2 and thus can carry out due to the operation of shaft 7 a predetermined grinding motion. The second grinding disk has a gear toothing for engaging with another gear toothing (18, 19) provided on the housing 2 whereby another grinding motion can be obtained. The third grinding disk has no toothings thereon and its grinding motion is obtained from the eccentric drive only and adjusted to the counter pressure force. Each grinding disk as described above can be provided with the suitable coating 16 with a favorable grain size for a required grinding.

In general, it is obtained due to the present invention, that for each planned ground slide with the grinding disk, the best grinding motion, the best coating hardness and the best grain size on the grinding paper can be selected. This is optimal. Each grinding disk may carry marks 23, 24 indicating a grinding fashion for an intended ground slide.

It will be understood that each of the elements described above, or two or more together, may also find a useful application in other types of eccentric grinders differing from the types described above.

While the invention has been illustrated and described as embodied in an eccentric grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An eccentric grinder comprising a rotation symmetrical housing; a plurality of interchangeable grinding disks selectively mounted to the grinder; a first drive means including a driving shaft, said housing being concentrical with said shaft; a second drive means including an eccentric drive shaft and being connected to a grinding disk mounted to the eccentric drive which drives a selected grinding disk, said first drive means further comprising a plurality of friction roll rings or gear toothings (18, 19) which are fixed to said housing and are rotation-symmetrically formed thereon, one of said roll rings or gear toothings having an internally engaging surface and another of said roll rings or gear toothings having an externally engaging surface one of said grinding disks being provided with friction roll rings or gear toothings having an internally engaging surface (22) positioned on said grinding disk eccentrically relative to said driving shaft adjusted to engage one of said roll rings or gear toothings fixed to said housing and having an externally engaging surface so that a rolling motion results between said grinding disk and said housing, such that selected grinding motion is applied to the grinding disk mounted to the grinder, another of said grinding disks being provided with friction roll rings or gear toothings having an externally engaging surface (20) positioned on said grinding disk eccentrically relative to said driving shaft adjusted to engage one of said roll rings or gear toothings fixed to said housing and having an internally engaging surface so that a rolling motion results between said grinding disk and said housing, such that selected grinding motion is applied to the grinding disk mounted to the grinder, another of said grinding disks being formed without said friction roll rings or gear toothings and when selected and mounted to the grinder providing that a grinding motion thereof is obtained from said eccentric drive only.

2. Eccentric grinder as defined in claim 1, wherein each grinding disk has a coating (16), the coating and a structure of each of said grinding disks being adjusted to a given grinding fashion "coarse-medium-fine".

3. Eccentric grinder as defined in claim 1, wherein each grinding disk carries marks indicating a grinding fashion for an intended ground slide.

* * * * *